US009057214B2

(12) United States Patent
Salice

(10) Patent No.: US 9,057,214 B2
(45) Date of Patent: Jun. 16, 2015

(54) HINGE FOR FURNITURE WITH A DEACTIVATABLE DECELERATING DEVICE

(71) Applicant: Arturo Salice S.p.A., Novedrate (IT)

(72) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 0 days.

(21) Appl. No.: 14/375,924

(22) PCT Filed: Oct. 16, 2013

(86) PCT No.: PCT/EP2013/071598
§ 371 (c)(1),
(2) Date: Jul. 31, 2014

(87) PCT Pub. No.: WO2014/067780
PCT Pub. Date: May 8, 2014

(65) Prior Publication Data

US 2014/0366322 A1 Dec. 18, 2014

(30) Foreign Application Priority Data

Oct. 29, 2012 (IT) ..... MI2012A1837

(51) Int. Cl.
*E05F 1/08* (2006.01)
*E05D 7/00* (2006.01)
(Continued)

(52) U.S. Cl.
CPC ..... *E05D 7/0009* (2013.01); *Y10T 16/538* (2015.01); *E05F 5/006* (2013.01); *E05F 5/02* (2013.01); *E05Y 2201/21* (2013.01); *E05Y 2201/264* (2013.01)

(58) Field of Classification Search
CPC ..... E05Y 2900/20; E05Y 2900/202; E05Y 2900/204; E05Y 2900/208; E05Y 2201/20; E05Y 2201/21; E05F 5/006; E05F 5/02; E05D 11/1021; E05D 11/1042; E05D 11/105; E05D 11/1064; E05D 7/04; E05D 7/0407; E05D 7/125; E05D 3/142
USPC ..... 16/286, 287, 288, 54, 56, 366, 370, 16/371, 354; 188/282.1, 282.2, 381, 266, 188/283, 280, 281
See application file for complete search history.

(56) References Cited

U.S. PATENT DOCUMENTS 5,269,043 A * 12/1993 Yang ..... 16/68
7,065,833 B2 * 6/2006 Kropf ..... 16/286
(Continued)

FOREIGN PATENT DOCUMENTS

| | | |
|---|---|---|
| AT | 509720 | 11/2011 |
| DE | 202005011752 | 11/2006 |
| WO | WO2009/124332 | 10/2009 |

OTHER PUBLICATIONS

International Search Report dated Dec. 2, 2013; International Application No. PCT/EP2013/071598; International Filing Date: Oct. 16, 2013; 4 pages.

(Continued)

*Primary Examiner* — Chuck Mah
(74) *Attorney, Agent, or Firm* — Blank Rome LLP

(57) ABSTRACT

A hinge (10) for mounting a door (14) on a piece of furniture, comprising a hinge arm (12) fixable to a fixed part (11) of the piece of furniture and a box (13) fixable to a door (14) of the piece of furniture, swingably connected to each other; connected to the box (13) there is a decelerating device (22) comprising an actuating element (24) movable along a decelerating stroke between an initial position and a final position, return spring means (25) loadable during the decelerating stroke from a released condition in a loaded condition, and deactivating means (39) for deactivating the decelerating device (22) and comprising a blocking member (39) acting on the return spring means (25) so as to block the same spring means (25).

17 Claims, 5 Drawing Sheets

(51) Int. Cl.
*E05F 5/00* (2006.01)
*E05F 5/02* (2006.01)

(56) References Cited

U.S. PATENT DOCUMENTS

| | | | | |
|---|---|---|---|---|
| 7,328,484 | B2 * | 2/2008 | Salice | 16/354 |
| 7,600,295 | B2 * | 10/2009 | Zimmer | 16/286 |
| 8,186,014 | B2 * | 5/2012 | Pecar et al. | 16/286 |
| 8,225,459 | B2 * | 7/2012 | Waltemate et al. | 16/366 |
| 8,418,317 | B2 * | 4/2013 | Wu et al. | 16/50 |
| 8,505,165 | B2 * | 8/2013 | Domenig et al. | 16/286 |
| 8,650,711 | B1 * | 2/2014 | Chen et al. | 16/54 |
| 2011/0291538 | A1 * | 12/2011 | Brunnmayr | 312/326 |
| 2012/0126677 | A1 * | 5/2012 | Ahlfeld | 312/326 |
| 2013/0139353 | A1 * | 6/2013 | Brunnmayr | 16/319 |
| 2013/0145580 | A1 * | 6/2013 | Brunnmayr | 16/277 |

OTHER PUBLICATIONS

Written Opinion dated Dec. 2, 2013; International Application No. PCT/EP2013/071598; International Filing Date: Oct. 16, 2013; 6 pages.
English abstract; Austrian Application No. AT509720; 1 page.
English abstract; International Application No. WO2009/124332; 1 page.
English translation; German Application No. DE202005011752; 9 pages.

* cited by examiner

HINGE FOR FURNITURE WITH A DEACTIVATABLE DECELERATING DEVICE

BACKGROUND OF THE INVENTION

The invention relates to a decelerated hinge for furniture doors, in particular a hinge suitable for being applied on pieces of furniture provided with a face frame for fixing the hinges themselves.

PRIOR ART

In the furniture industry, for the purpose of supporting furniture doors in a swingable fashion, use is conventionally made of hinges comprising a fixed part connectable to the body of the piece of furniture and a movable part consisting of a box connectable to the door, joined together by swinging means.

In the case of pieces of furniture with a face frame for fixing the hinges, typically used on the American market, the hinges themselves generally require the box to be connected to an arm of the fixed part by means of a single articulation pin.

In order to maintain the door in a closed position, the hinges further comprise suitable spring means, for example in the form of torsion springs placed in proximity to the side walls of the box, or else in the form of a leaf spring fixed inside the box in a central position and loaded in such a way as to draw the arm of the fixed part in the closing direction of the hinge.

In order to decelerate the closing movement of the hinge imposed by the aforesaid spring means, a decelerating device, preferably of the linear type, can be placed inside the box; the device normally comprises a housing body, a slider movable along a decelerating stroke between an initial extended position and a final contracted position and return spring means.

Moreover, decelerating devices can optionally be provided with means for deactivating the deceleration function to enable the installer and/or user to establish how many of the hinges arranged on each door will function in a decelerated manner so as to optimize the door closing movement based on the weight and dimensional characteristics of the door itself.

The known deactivating means comprise a member for blocking the slider; this member can be actuated by the user either manually or with a tool so as to be moved linearly or rotatably from a releasing position to a blocking position in which it hooks the slider again in a releasable manner in order to hold it in the final contracted position, deactivating its operation.

However, such a solution for the deactivating means has some drawbacks, since the slider remains blocked in the contracted position under the bias force of the return spring means; in such a condition, the hinge arm exerts a cyclical pushing action as it rests against the slider in the closed position of the hinge and provokes stresses that can cause damage or an undesired release of the blocking member by the slider, with consequent problems in the overall operation of the doors during closing.

OBJECTS OF THE INVENTION

The object of the present invention is therefore to provide a decelerated hinge for furniture doors, in particular for pieces of furniture provided with a face frame for fixing, which has means for deactivating the decelerating device that are of simple construction and do not directly stress the decelerating device, thus lending it high reliability with the aim of preventing undesirable reactivations of the decelerating device itself.

BRIEF DESCRIPTION OF THE INVENTION

All the above is achievable by means of a hinge for mounting a door on a piece of furniture, comprising:

- a hinge arm fixable to a fixed part of the piece of furniture;
- a box fixable to a door of the piece of furniture, the box being swingably connected to said hinge arm; and
- a decelerating device connected to said box, the device comprising a housing body, an actuating element movable along a decelerating stroke between an initial position and a final position, return spring means loadable during said decelerating stroke from a released condition to a loaded condition, and deactivating means for deactivating said accelerating device, characterized in that said deactivating means act on said return spring means independently of the actuating element and comprise a blocking member acting on said return spring means so as to block the same spring means.

Additional features of the present invention are moreover defined in the subsequent claims.

BRIEF DESCRIPTION OF THE DRAWINGS

The features and advantages of the present invention will be more apparent from the subsequent description of preferred but non-limiting embodiments of the hinge for pieces of furniture with a deactivatable decelerating device, with reference to the appended figures, in which.

DETAILED DESCRIPTION OF THE INVENTION

Figure 1:
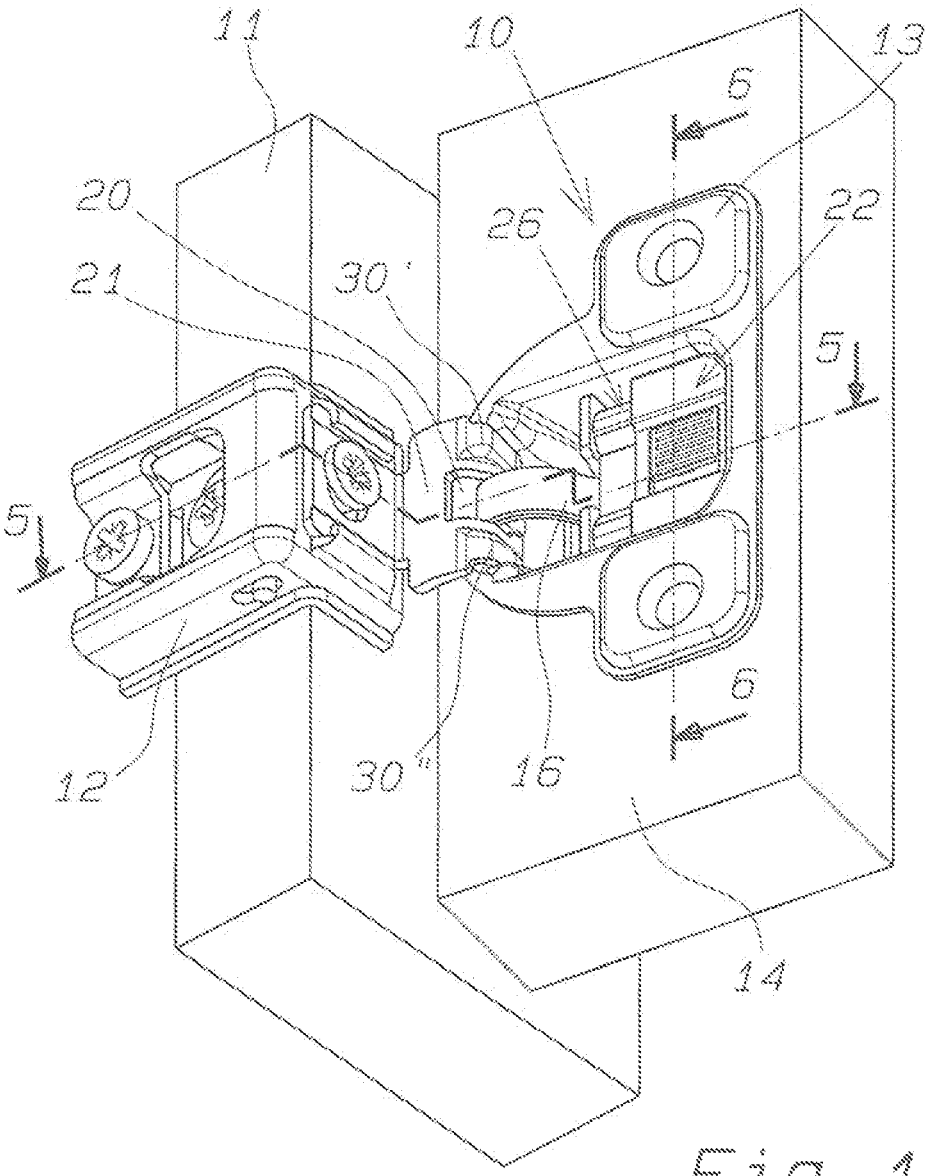
FIG. 1 is a perspective view of the hinge according to a first embodiment of the invention.
Figure 2:
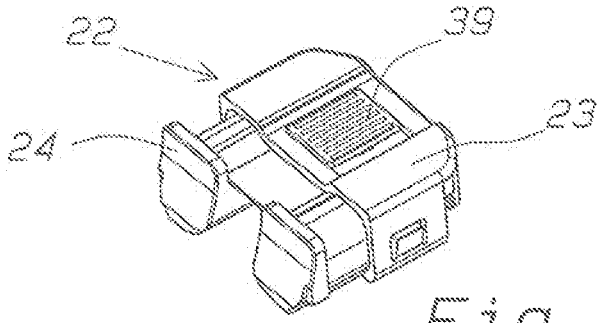
FIG. 2 is a perspective view of the decelerating device of the hinge of FIG. 1.
Figure 4:
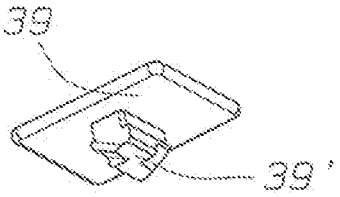
FIG. 4 is a perspective view from below of the blocking member for the decelerating device of FIG. 2 on an enlarged scale.

FIGS. 1 to 8 illustrate a first embodiment of a hinge according to the present invention, which is indicated overall with the numerical reference 10, and is particularly suitable for an application to American-type pieces of furniture provided with a face frame 11 on which the hinges are fixed.

A hinge 10 of this kind generally comprises an arm 12 for using the hinge itself to a fixed part of the piece of furniture, in particular to the face frame 11, and a box 13 for fixing to a door 14 of the piece of furniture.

Figure 5:
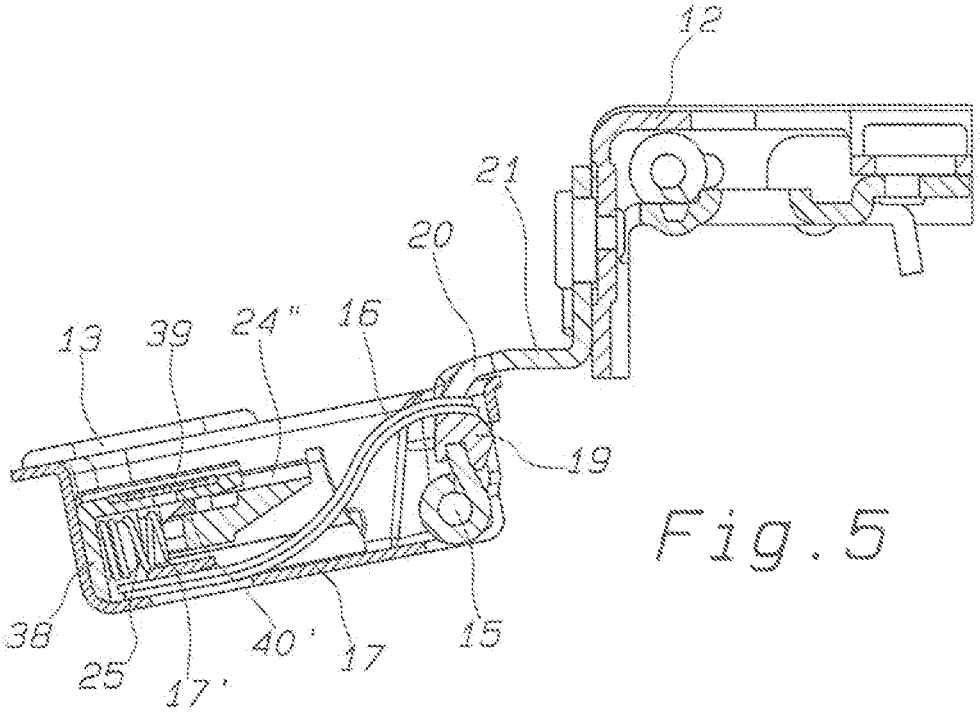
FIG. 5 is a longitudinal section view of the hinge of FIG. 1 according to the line 5-5 with the blocking member in the releasing position.

As better illustrated in FIG. 5, the box 13 is swingably connected to the fixing arm 12 at a rear longitudinal end of the box 13 itself, preferably by means of a single swing pin 15 that extends transversely relative to the longitudinal axis of the fixing arm 12, in such a way that the box 13 can rotate between an open position of the door, illustrated in the figure, and a closed position of the door, not illustrated, under the action of spring closing means of a known type, for example at least a leaf spring 16, disposed centrally and longitudinally inside the box 13.

Figure 6:
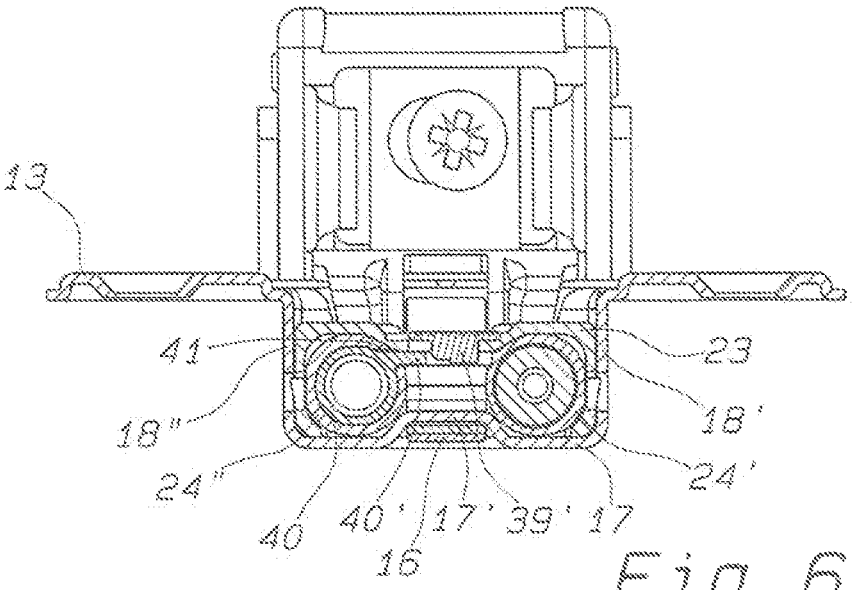
FIG. 6 is a cross-section view of the hinge of FIG. 1 according to the line 6-6 with the blocking member in the releasing position.

As illustrated in FIGS. 5 and 6, the box 13 of the hinge comprises a bottom wall 17 and side walls 18', 18" which extend longitudinally on opposite sides of the box starting from the rear end.

In a front area the bottom wall 17 has a bridge 17', which can be obtained by cutting and plastic deformation of the metal sheet, and which defines an insertion seat for a front end of the leaf spring 16; the rear end of the spring 16 is instead curved toward the swing pin 15 and rests on a cam 19 inserted on the lower edge of an opening 20 formed in a front part 21 of the hinge arm 12.

The hinge 10 further comprises a decelerating device 22 connected to the box 13, for example inserted into the box 13 or in any case applied to the box 13, the device 22 comprising a retaining or housing body 23, an actuating element 24 which is movable along a decelerating stroke between an initial position and a final position, return spring means 25 loadable during the decelerating stroke from a released condition to a loaded condition, and deactivating means for deactivating the decelerating device, as explained further below.

Preferably, the decelerating device 22 is of the linear type, is arranged inside the hinge box 13 and comprises a fluid decelerating cylinder 26; in this case, the actuating element 24 is in the form of a slider movable according to a longitudinal direction and having a rear end actuatable by the front part 21 of the hinge arm 12.

It is not ruled out, however, that the decelerating device can be of a different type, for example of a rotating type, provided in any case with an actuating element that is movable along a decelerating stroke between an initial position and a final position and return spring means for bringing the actuating element back into the initial position following the decelerating stroke.

In the linear decelerating device 22 of the example embodiment illustrated in FIGS. 1 to 8, the fluid decelerating cylinder 26 and the return spring means 25 extend parallel to and spaced apart from each other, with the fluid decelerating cylinder disposed in proximity to a first side wall 18' of the box 13 and the return spring means 25 disposed in proximity to the opposite side wall 18" of the box 13, the cylinder 26 and the return means 25 thus being disposed separately from each other along respective opposite sides of the leaf spring 16 itself.

The housing body 23 of the decelerating device 22 can be fixed in the hinge box 13 at the front end thereof and the slider 24 is slidingly disposed at least partially in the housing body 23 parallel to the bottom wall 17 of the box 13, or else slidingly disposed between the housing body 23 and the bottom wall 17 of the box 13.

Figure 8:
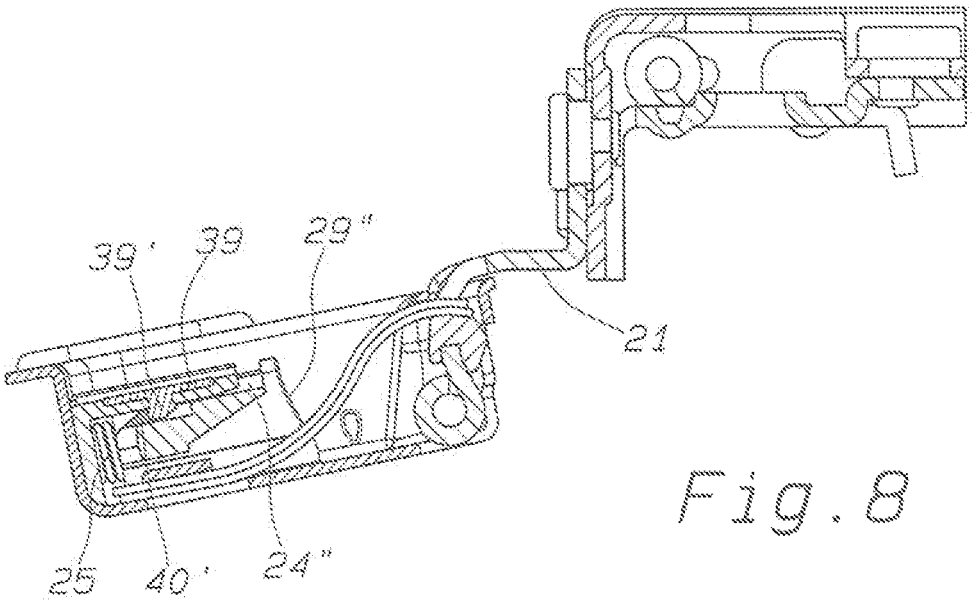
FIG. 8 is a longitudinal sectional view of the hinge of FIG. 1, with the return spring means blocked.

The slider 24 is movable between an initial extended position, corresponding to the open position of the hinge illustrated in FIG. 5, and a final contracted position, illustrated in FIG. 8, corresponding to the closed position of the hinge or the deactivated condition of the decelerating device 22.

Figure 3:
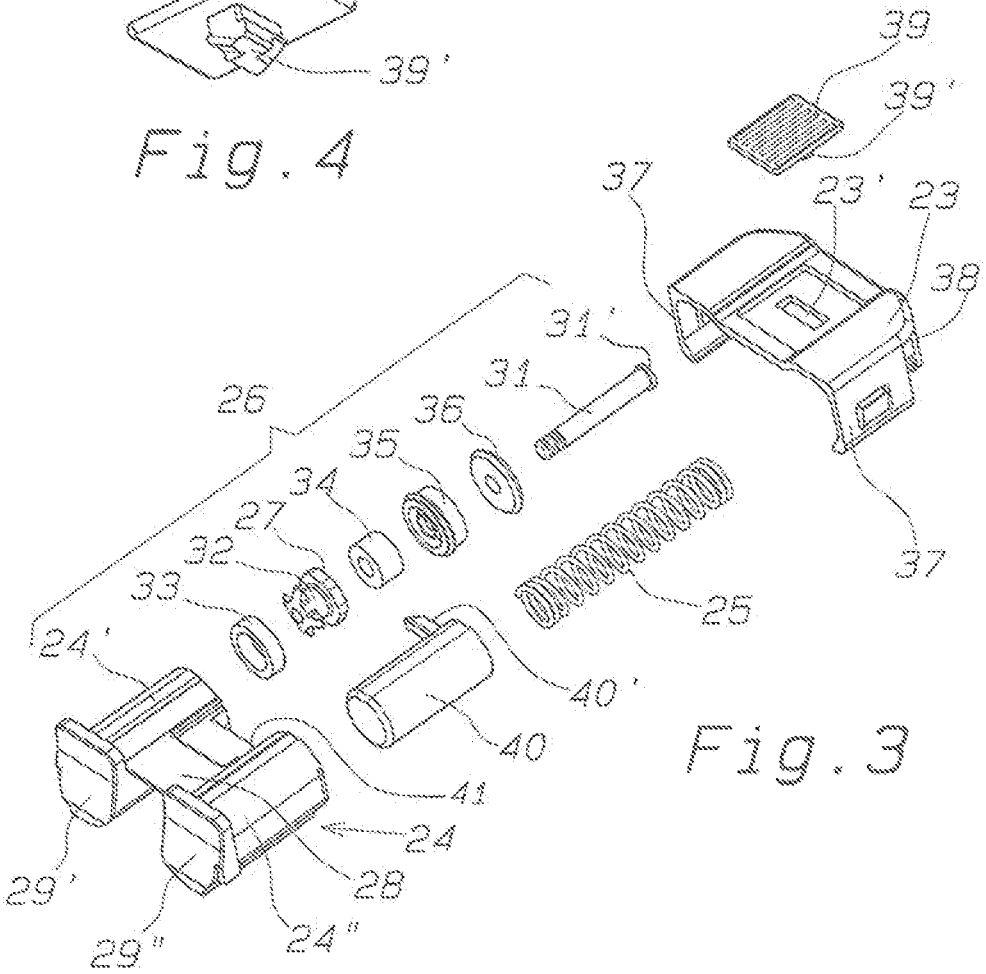
FIG. 3 is an exploded perspective view of the decelerating device of FIG. 2.

As better illustrated in FIG. 3, the decelerating cylinder 26 comprises a piston 27 movable in a chamber for the fluid, which consists, for example, of air or preferably oil or another viscous fluid.

Preferably, the slider 24 comprises a host 24' and a second 24" cylindrical hollow parts operatively connected with each other, for example by means of a cross connecting element 28, and which extend parallel to and spaced apart from each other; the first cylindrical hollow part 24' defines the chamber for the piston 27 of the decelerating cylinder, while the second cylindrical hollow part 24" defines a housing seat for the return spring means 25.

For the purpose of actuating the decelerating device, the first and second cylindrical parts 24', 24" of the slider 24, at one end which extends from the housing body 23 in the direction of the rear end of the box 13, have respective closing walls 29', 29" provided with shaped surfaces or cams for contacting corresponding driving surfaces 30', 30" provided on the hinge arm 12; in particular, with reference to the preferred embodiment illustrated, the driving surfaces 30', 30" extend on bent sections of the front part 21 of the arm 12, at the sides of the opening 20 for the leaf spring 16.

With reference again to FIG. 3, the piston 27, on a front side thereof, includes a blind axial hole for inserting a rod 31 under pressure and peripherally has an annular groove 32 for housing a ring gasket 33.

The cylinder 26 further comprises an annular volume compensation element 34, preferably in the form of a closed-cell rubber ring, as well as a ring seal 35, for example of the lip type, for assuring a seal between the piston rod 31 and inner surface of the piston chamber.

Finally, the cylinder 26 comprises an annular closing cover 36 for closing the chamber, fixable to the front end of the first cylindrical part 24', for example by providing a snap-engageable annular recess for a peripheral edge of the cover.

The piston rod 31 extends at a front end of the first cylindrical part 24' of the slider 24, ending with a head 31' that can be hooked onto the housing body 23 of the device.

Preferably, the housing body 23 has a top wall and two side walls 37 which extend according to a U-shaped cross section, as well as a front wall 38 provided with a seat for hooking onto the head 31' of the piston rod 31.

As said, the hinge 10 comprises means for deactivating the decelerating device, in order to enable the installer and/or user of the piece of furniture to establish how many of the hinges arranged on each door will function in a decelerated manner so as to optimize the door closing movement based on the weight and dimensional characteristics of the door itself.

According to the present invention, the deactivating means comprise a blocking member 39 acting on the return spring means 25 so as to block the same means, independently of the actuating element 24 of the decelerating device 22.

Preferably, the blocking member 39 is movable between a releasing position, illustrated in FIGS. 5 and 6, and a blocking position, illustrated in FIG. 8, in which it causes the return spring means 25 to be blocked in the loaded condition; this loaded condition can be a condition of total or partial loading of the return spring means 25, depending on whether it is desired to have a total or only partial deactivation of the decelerating effect.

In the preferred embodiment of the present invention, illustrated in FIGS. 1 to 8, the hinge 10 comprises a biasing element 40 for the return spring means 25 separated from the actuating element 24, the biasing element 40 being engageable by the blocking member 39 in the blocking position thereof.

Preferably, as better illustrated in FIG. 3, the return spring means, designed to bring the slider 24 from the contracted position back into the extended position, comprise at least a helical spring 25; in such a case, the biasing element 40 is connectable to a rear end of the return spring 25.

In particular, the biasing element 40 is preferably a cup-shaped element inserted on the rear end of the return spring 25 and has a side projection 40' engageable by the blocking member 39.

It is not ruled out, however, that the biasing element can have a different shape and/or arrangement, provided that it is capable of exerting a biasing force and maintaining the return spring means in the loaded condition.

The cup-shaped biasing element 40 is slidably inserted in the second cylindrical part 24" of the slider 24, which longitudinally has a side passing slot 41 for the side projection 40" of the biasing element 40 which is engageable by the blocking member 39.

In such a case, the return spring 25 extends between the front wall 38 of the housing body 23 and the bottom of the cup-shaped biasing element 40 inserted in the second cylindrical part 24" of the slider.

In the first embodiment illustrated in FIGS. 1 to 8, the blocking member 39 has a body movably supported on the top wall of the housing body 23 and a projecting part 39' which extends through a through hole 23' provided on the top wall of the housing body 23 so as to indirectly block the return spring 25 via the cup-shaped biasing element 40.

Preferably, the blocking member 39 is transversally movable relative to the longitudinal moving direction of the slider 24; to this end, the through hole 23' extends transversally along the top wall of the housing body 23.

Moreover, the projecting part 39' of the blocking member 39 which projects in a longitudinal direction is disposed in a rearward position relative to the side projection 40' of the biasing element 40 when the slider 24 is set in the final contracted position.

It is not ruled out, however, that the blocking member can alternatively be supported in a rotating or swinging manner, with a suitably shaped part disposed for engaging with the biasing element.

For the purpose of fixing the blocking member 39, the projecting part 39' thereof preferably has peripheral fixing means that are snap-engageable with the peripheral edge of the through hole 23' provided in the housing body 23.

Moreover, the blocking member 39 has gripping or driving means actuatable manually or with a tool, for example in the form of knurls or gripping ridges.

The operation of the hinge 10 is as follows: when the decelerating action is required during the closing movement of the hinge, the blocking member 39 must be disposed in the releasing position illustrated in FIGS. 5 and 6, so that the cup-shaped biasing element 40 is freely movable longitudinally together with the slider 24 under the action of the return spring 23. In such a case the slider 24 is made to return into the initial position following the decelerating stroke once the hinge is brought into the opening position.

Figure 7:
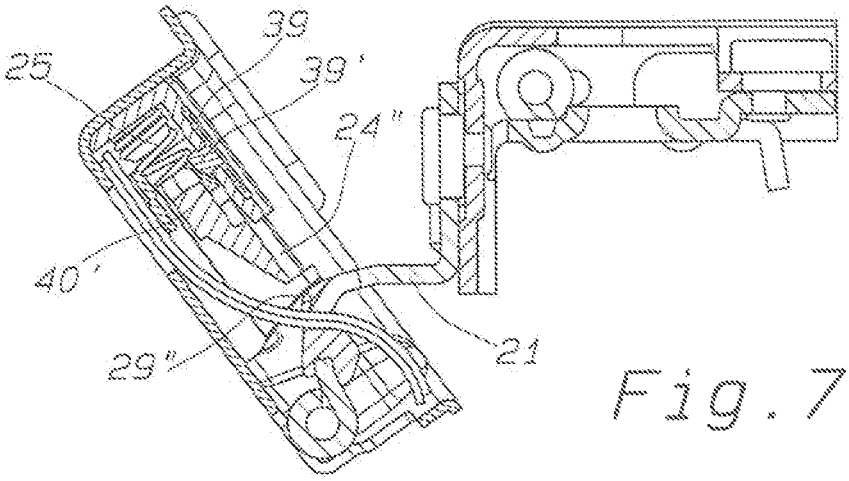
FIG. 7 is a longitudinal sectional view of the hinge of FIG. 1 with the blocking member in the blocking position so as to cause the blocking of the return spring means at the end of a decelerating stroke starting from the partially closed position illustrated.

However, if there is a need to deactivate the decelerating device 22 of a hinge 10, for example to reduce the braking action in the case of small-sized or lightweight doors, the user, while the hinge is open, must move the blocking member 39 transversally so as to bring it into the blocking position illustrated in FIGS. 7 and 8. In this manner, the projecting part 39', which extends below the blocking member 39, will be on the trajectory of longitudinal movement of the side projection 40'.

When a first closing movement of the hinge 10 is made, the front part 21 of the arm 12 will push the slider 24 together with the biasing element 40 until causing the side projection 40' of the biasing element 40 to hook onto the projecting part 39' of the blocking member 39 in the contracted position of the slider 24 itself.

This hooking takes place thanks to the elasticity and/or receiving surfaces provided on the parts, which favour the passing over and reciprocal engagement of the projection 40' of the biasing element 40 and the projecting part 39' of the blocking member 39.

In such a hooked condition, the biasing element 40 retains the return spring 25 in the loaded condition, preventing the return of the slider 24, which is free and disengaged from the biasing element 40 itself, so as not to be subject to stresses deriving from the return spring 25.

Finally, if there is a need to reactivate the decelerating device 22, the user must move the blocking member 39 transversally to bring it into the releasing position, in such a way as to free the biasing element 40 and thereby permit the return spring 25 to bring the slider 24 back into the initial extended position when the door is open.

Figure 9:
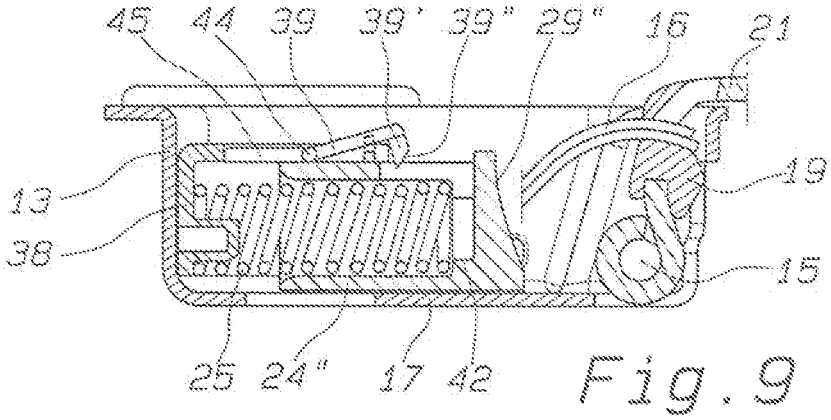
FIG. 9 is a partial longitudinal sectional view of a second embodiment of the hinge according to the invention, in which the blocking member of the deactivating means, illustrated in the releasing position, is directly engageable with the return spring means.
Figure 10:
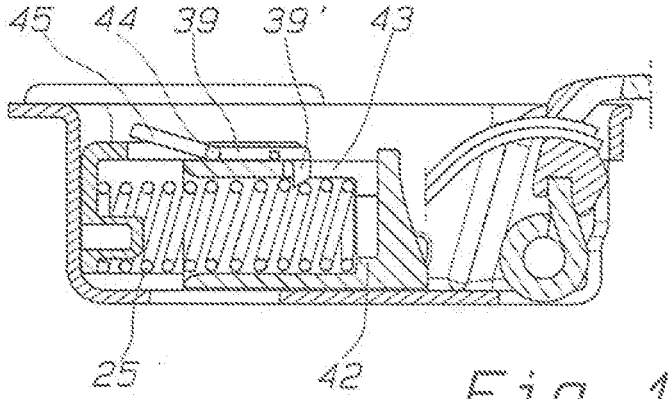
FIG. 10 is a longitudinal sectional view of the hinge of FIG. 9, with the blocking member in the blocking position so as to cause the blocking of the return spring means at the end of a decelerating stroke.
Figure 11:
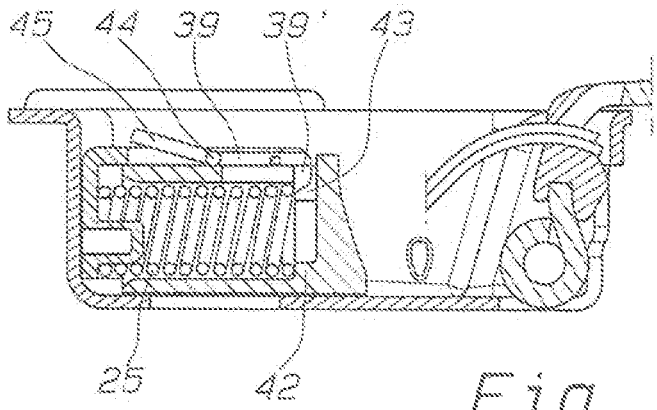
FIG. 11 is a longitudinal sectional view of the hinge of FIG. 9 with the return spring means blocked.

FIGS. 9 to 11 illustrate a second embodiment of the invention, in which the same numerical references have been used to indicate similar or equivalent parts.

In this embodiment, in general, the blocking member 39 has a hooking part 39' directly engageable with the return spring means 25.

In the preferred case in which the return spring means 25 comprise at least a helical spring having a plurality of coils, arranged between the front wall 38 of the housing body 23 and the bottom of the second cylindrical part 24" of the slider 24, when the blocking member 39 is set in the blocking position, the hooking part 39' is conformed and disposed so as to longitudinally slide along the coils of the return spring 25 starting from the position illustrated in FIG. 10. During a first closing movement of the hinge, the hooking part 39' becomes engaged at the rear end of the spring 25 itself in the loaded condition, as illustrated in FIG. 11, preventing the subsequent extension thereof.

To this end, the hooking part 39' preferably has a slanted sliding surface 39" for the coils of the return spring 25.

Moreover, in order to permit the hooking of the part 39' onto a coil of the spring 25 in a position as far back as possible toward the rear end thereof, on the bottom of the second cylindrical part 24" of the slider 24 a spacer 42 is provided to distance the end of the spring 25 from the bottom itself, in such a way as to define the necessary insertion seat for the hooking part 39'.

In the preferred case illustrated, in which the actuating element of the decelerating device is in the form of a slider 24 comprising a first 24' and a second 24" cylindrical hollow parts operatively connected with each other, the second cylindrical part 24" longitudinally has a side slot 43 extending up to a rear end of the slider 24 for the access of the part 39' of the blocking member 39 directly engageable with the return spring 25.

In this embodiment, the blocking member 39 has a body supported swingingly or rotatingly according to a transversal axis 44 parallel to the bottom wall 17 of the box 13; there is further provided a drive arm 45, which extends at an angle relative to the body of the blocking member 39 in order to enable an alternating actuation of the member itself under pressure on the body 39 or arm 45.

From the foregoing it is evident that the decelerated hinge according to the invention has a deactivatable decelerating device that is simple in construction and has high reliability, since in the deactivated condition the actuating element is not subjected to bias force by the return spring means, which are directly blocked in their loaded position; in this manner, undesired reactivations of the decelerating device are avoided.

In order to deactivate the decelerating device 22, the deactivating means 39 can be conformed and arranged not only to deactivate the decelerating device 22 completely, as previously illustrated, but also, in a different embodiment, to deactivate it only partially, for example by conforming or positioning the projection 40' of the biasing element 40 and/or the hooking part 39' of the blocking member 39.

The hinge according to the invention is susceptible of modifications and variants falling within the scope of the inventive concept; moreover, the constructive details may be replaced with other technically equivalent ones.

The invention claimed is:

1. A hinge for mounting a door on a piece of furniture, comprising:

a hinge arm fixable to a fixed part of the piece of furniture;

a hinge box fixable to a door of the piece of furniture, the hinge box being swingably connected to said hinge arm; and a decelerating device connected to said hinge box, the decelerating device comprising:

a housing body, an actuating element, movable in relation to said housing body, and movable along a decelerating stroke between an initial position and a final position, said initial position corresponding to an open position of the hinge, with said actuating element extended from said housing body, and said final position corresponding to a closed position of the hinge, with said actuating element contracted to said housing body, a return spring communicating with said actuating element and said housing body, said return spring loadable during said decelerating stroke from a released condition to a loaded condition, and a deactivating element for deactivating said decelerating device;

wherein said deactivating element acts on said return spring independently of the actuating element and comprises a blocking member acting on said return spring for blocking the return spring in a totally or partially loaded condition.

2. The hinge of claim 1, wherein the blocking member is movable between a releasing position and a blocking position, where, in the blocking position, the blocking member blocks the return spring in the loaded condition.

3. The hinge of claim 1, wherein the decelerating device is of a linear type, is arranged inside the hinge box and comprises an actuating element configured as a slider movable according to a longitudinal direction, the slider having a rear end actuatable by a part of said hinge arm.

4. The hinge of claim 3, wherein the slider has a first and a second cylindrical hollow part connected to one another by a cross connecting element, said first cylindrical hollow part defining a chamber for a fluid decelerating piston, said second cylindrical hollow part defining a housing seat for the return spring.

5. The hinge of claim 4, further comprising a biasing element, wherein the biasing element is cup-shaped, and is slidably inserted in said second cylindrical hollow part of the slider, said second cylindrical hollow part longitudinally having a side passing slot for a side projection of the cup-shaped biasing element engageable by said blocking member.

6. The hinge of claim 4, wherein the second cylindrical hollow part of the slider longitudinally has a side slot extending up to a rear end of the slider for access of a hooking part of the blocking member directly engageable with the return spring.

7. The hinge of claim 3, wherein the blocking member is transversally movable with respect to a longitudinal moving direction of the slider.

8. The hinge of claim 1, further comprising a biasing element for the return spring, separated from said actuating element, said biasing element engaging said blocking member in a blocking position thereof, where said blocking member acts on said return spring for blocking the return spring in a totally or partially loaded condition.

9. The hinge of claim 8, wherein the return spring comprises at least one helical spring, and wherein the biasing element is connectable to a rear end of the at least one helical spring.

10. The hinge of claim 9, wherein the biasing element is a cup-shaped element inserted on a rear end of the return spring, the cup-shaped biasing element having a side projection engageable by the blocking member.

11. The hinge of claim 1, wherein the blocking member has a hooking part directly engageable with the return spring.

12. The hinge of claim 11, wherein the return spring comprises at least one helical spring having a plurality of coils, and wherein the hooking part of the blocking member, in a blocking position, engages one of the plurality of coils, thereby preventing a subsequent extension of the return spring, and wherein the hooking part is further conformed and arranged for longitudinally sliding along the coils of the return spring, during further return spring loading, until engagement at a rear end of the return spring in the loaded condition during a closing movement of the hinge.

13. The hinge of claim 12, wherein the hooking part has a slanted sliding surface, facilitating the longitudinal sliding along the coils of the at least one helical spring of the return spring.

14. The hinge of claim 1, wherein the housing body has a top wall having a through hole, and wherein the blocking member has a body movably supported on the top wall of the housing body and a projecting part extending through said through hole for directly or indirectly blocking said return spring.

15. The hinge of claim 14, wherein the projecting part of the blocking member has peripheral snap-on fixing means engageable with a peripheral edge of said through hole provided on the housing body.

16. The hinge of claim 1, wherein the blocking member has gripping means actuatable manually or by a tool.

17. The hinge of claim 1, wherein the deactivating element is arranged and conformed for at least a partial deactivation of the deceleration device.

* * * * *